United States Patent [19]

Andrawos

[11] Patent Number: 4,592,167

[45] Date of Patent: Jun. 3, 1986

[54] DOORS

[75] Inventor: Emile Andrawos, Seacliff Park, Australia

[73] Assignee: Combi Door Australia Pty. Ltd., St. Marys, Australia

[21] Appl. No.: 580,139

[22] Filed: Feb. 14, 1984

[30] Foreign Application Priority Data

Oct. 28, 1983 [AU] Australia ..... 20810/83

[51] Int. Cl.[4] ..... E06B 7/28

[52] U.S. Cl. ..... 49/171; 49/62; 160/180

[58] Field of Search ..... 49/171, 169, 62; 160/180, 104

[56] References Cited

U.S. PATENT DOCUMENTS

| | | | |
|---|---|---|---|
| 1,289,753 | 12/1918 | Haydon | 49/169 X |
| 1,788,928 | 1/1931 | Mills | 49/169 X |
| 2,152,566 | 3/1939 | Phillips | 49/171 X |
| 2,249,386 | 7/1941 | Jones | 160/104 |
| 2,822,041 | 2/1958 | Blankenship | 160/104 X |
| 2,888,071 | 5/1959 | Therien | 49/169 X |
| 2,918,708 | 12/1959 | Sharp et al. | 160/91 X |
| 2,962,773 | 12/1960 | Heller | 160/91 X |
| 3,871,434 | 3/1975 | Hance | 49/62 X |
| 3,895,669 | 7/1975 | Heeling | 49/171 X |

*Primary Examiner*—Philip C. Kannan

*Attorney, Agent, or Firm*—Cushman, Darby & Cushman

[57] ABSTRACT

A solid door for a dwelling, the door combining the features of security, ventilation and insect protection.

The door has an aperture covered by a security grill and an insect screen.

A sliding panel is fitted to the side of the door facing the interior of the dwelling so that the panel can close the aperture, or be opened to allow ventilation while still maintaining security and the exclusion of insects from the building.

3 Claims, 3 Drawing Figures

DOORS

This invention relates to doors, more particularly to improvements in or relating to doors whereby a door may be provided to have ventilation through the door as well as having security of a door in the ventilating mode.

It is well known for buildings, particularly domestic buildings, that as well as the normal door providing access to the building being provided, a separate door usually called an insect-screen door is provided for use when the main door is open so that ventilation through the door can occur whilst preventing the entry into the building of insects. However in more recent times it has been found that the screen door does not offer sufficient security to prevent the entry of an unauthorised person, and thus combined screen doors and security doors have been provided.

In order to overcome the problem of having two separate doors, one opening inwardly and the screen and security door opening outwardly, a combined door has been provided in which the main door is provided with an aperture, which is usually provided with a security screen and an insect-screen, a panel closing the door being hinged to the door itself. While this is satisfactory to some degree in overcoming the problem of having two separately hung doors, the problem does arise in that provision must be made for latching the hinged panel portion to an open position, this latching also providing for the relative movement to take place between the hinged panel portion and the wall or other area to which the panel portion is attached, and also to allow for the relative movement between the hinged panel portion and the main door during the opening and closing thereof.

It is an object of this invention to overcome the above problems which arise with the hinged panel portion.

Thus there is provided according to this invention an insert to be inserted into an aperture of a solid door, the insert carrying a security screen and insect screen, and tracks being provided on the inside surface of the door whereby a sliding panel is adapted to slide parallel to the surface of the door from a position exposing the aperture to a position closing the aperture, sealing means being provided to seal the sliding panel to the insert when in the closed position.

Thus it will be seen that by providing the sliding panel, very little extra space is required for the door, and also it is not necessary to latch or otherwise secure the panel to any fixture externally of the door when in the open position.

In order to more fully describe the invention reference is now made to the accompanying drawings in which.

Figure 1:
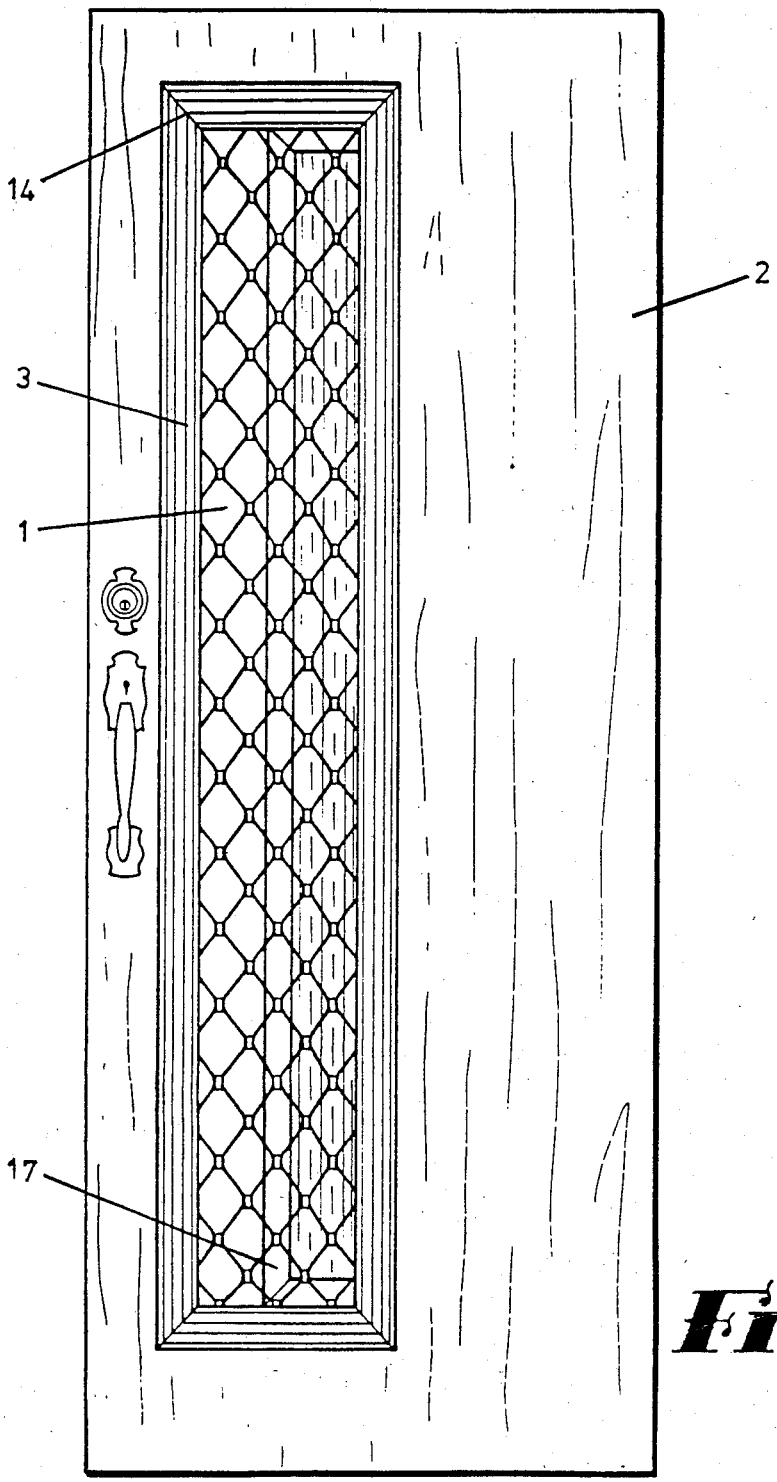
FIG. 1 is a view of the front or outside of a door.
Figure 2:
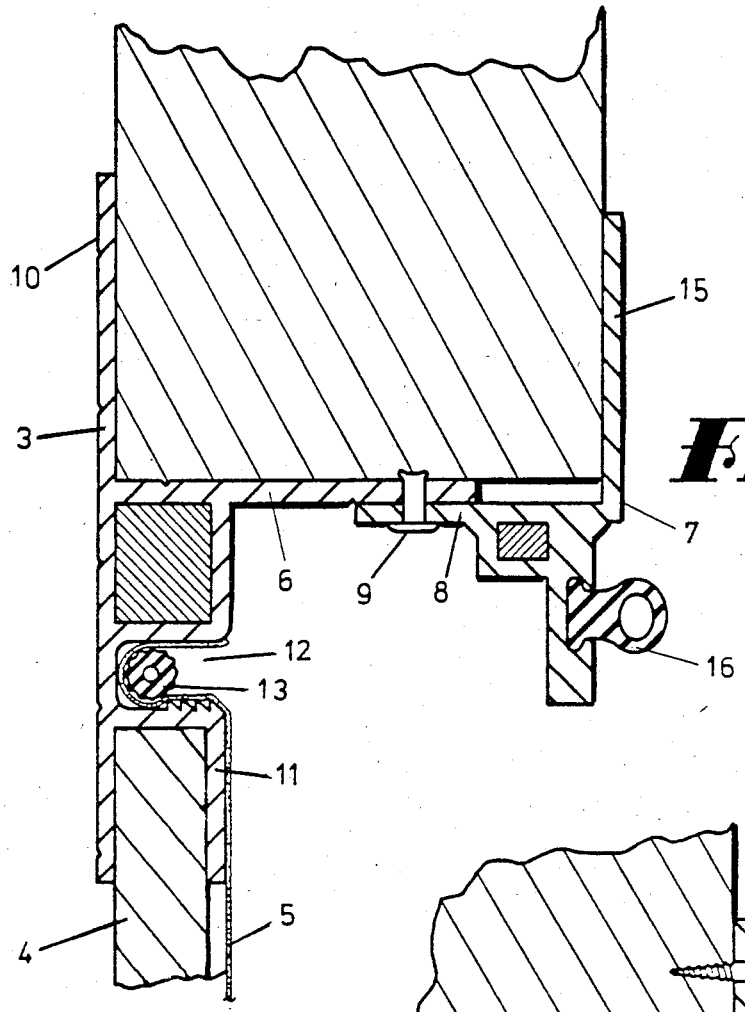
FIG. 2 is a part cross-sectional view of a vertical portion of the insert.

In a preferred form of the invention the aperture 1 in the door 2 can be of any suitable shape, and preferably the aperture 1 could extend longitudinally of the door and be provided in the half of the door either toward the latch side or the hinge side thereof. Alternatively the aperture could be provided at the top half of the door so that the sliding panel would be able to slide upwardly and downwardly to cover and uncover the door aperture.

The aperture in the door can be provided through an existing hung door or can be provided during manufacture of the door.

The invention comprises an outside frame 3 carrying the security grill 4 and the insect-screen 5, the frame having an inwardly projecting leg 6 to pass closely adjacent to the inside edge of the aperture. Also there is provided an inside frame 7, this frame 7 also including a leg 8 adapted to protrude into the aperture in overlapping relationship with the leg 6 on the outside frame 3, means being provided to suitably lock and locate the two legs together, such as a rivet 9, screw, self tapping screw or the like.

The outside frame 3 and the inside frame 7 can each be formed of extruded aluminium section, the outside frame having an outer facing portion 10, a portion of this outer face extending in overlapping relationship with the surface of the door surrounding the aperture.

On the aperture side of the outside frame 3, there is provided a channel-shaped section 11 which is adapted to securely receive the security grill 4.

Adjacent the channel-shaped section 11 facing the aperture, there is provided a further channel-shaped opening 12, this channel-shaped opening facing the opposite or inside side of the door 2, the channel-shaped section 12 being adapted to receive the insect screen 5 and be retained in position in known manner by a suitable resilient rubber or plastics tube or rod 13.

The outside frame 3 is joined at its corners 14 in conventional manner by connecting pieces, the outside frame being assembled with the security screen 4 and the insect-screen 5 in position ready for insertion in the aperture of the door.

The inside frame 7 also includes a facing portion 15, and also the leg 8 to be attached to the leg 6 of the outside frame 3 in overlapping relationship.

This attachment can be by suitable screws 9 or the like passing through suitable apertures in the overlapping legs these apertures either being drilled during assembly, or being provided as slots, or suitable serrated teeth or other interengaging and locking formations can be provided on the overlapping portions to hold the inside and outside frames in locked position.

The inside frame 7 on its outer surface is provided with a suitable sealing member 16 in the form of a ring or bead or the like, this protruding from the surface of the inside frame.

A sliding panel 17 is also provided, this being adapted to slide in tracks 18 which are attached either to the surface of the door itself or the inside frame 7 so that the sliding panel may be moved from a position covering the aperture to a position exposing the aperture in which instance the sliding panel is located over that portion of the door, adjacent the aperture.

The track 18 is preferably mounted on the frame 7 so that a single fastening member such as screws 19 can affix both at the same time. Preferably the track 18 includes a central web 19 on which the roller 20 runs, and a pair of side members 21 each carrying conventional sealing and dust excluding pads or brushes 22. The panel 17 carries the roller 20 in a hollow or recess in the panel so that the sides of the panel 17 protrude past the roller 20 and seal against the members 22.

Figure 3:
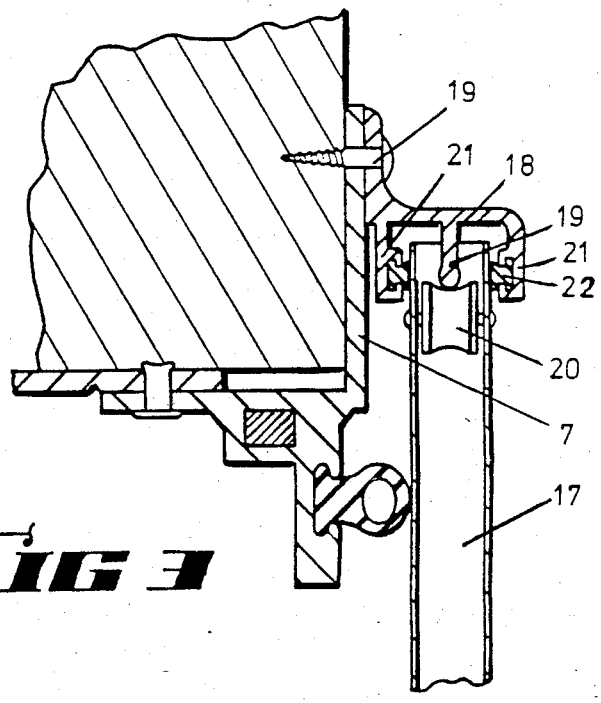
FIG 3 is a part cross-sectional view of the top of the insert.

It will be realised that the bottom of the aperture and panel will be the same as that shown in FIG. 3 except that the track and rollers are inverted. Preferably the panel 17 will carry two rollers at the top and two at the bottom, these being positioned near the vertical edges of the panel.

The sliding panel can be a solid panel either being non-transparent, or transparent or translucent. Thus the panel could be of wood or plywood, of metal, of glass either clear, coloured or translucent or be of a suitable plastics material such as celluloid, polycarbonate, or other suitable material.

Means are provided to co-operate between the sliding panel and the track or the door itself to lock the panel in these extreme positions, and also in an intermediate position if so desired.

The sliding panel in its closed position would seal against the sealing ring 16 to thus seal and prevent flow of air through the aperture and around the sliding panel.

The sealing member can be of rubber, butyl rubber, neoprene or any other suitable sealing material.

It is to be noted that the invention can be provided in kit form for installation by a handy-man or the like in which case it is necessary to cut an aperture in the door to the desired size, this size being indicated by a template or the like which is supplied with the kit.

The outside frame is fully assembled with the security screen and the insect-screen in position, and this is then inserted into the aperture from the outside of the door.

The inside frame is then positioned from the inside of the door, the frames being locked together in the manner previously described.

The tracks for the sliding panel can then be installed on the door or if the tracks are incorporated with and form part of the inside frame they would be installed with the frame, and the sliding panel can then be inserted if it is not already assembled with the tracks.

Alternatively the door could be constructed and sold with the aperture and panel already assembled.

As noted above the aperture can be of any suitable size either extending vertically with the panel sliding horizontally, or the aperture could be positioned centrally of the upper portion of the door with the panel sliding vertically to cover and uncover the aperture.

Alternatively the aperture could have other shape and configuration depending upon the appearance required.

Where throughout the specification and claims reference is made to a solid door this is intended to include any door of either solid or laminated or hollow construction, as long as the door does not normally have any ventillating portions or apertures therethrough, and can be of any material whether wood, plywood, chipboard, metal, plastic or the like.

Although one form of the invention has been described in some detail it is to be realised that the invention is not to be limited thereto but can include various modifications falling within the spirit and scope of the invention.

I claim:

1. A solid door having a ventilating closeable security aperture therethrough, an insert comprising an outer frame to be fitted to the aperture to pass into the aperture, an inner frame to be fitted to the aperture on the inside of the door, said outer frame having secured thereto a security grille and adjacent thereto an insect screen to both cover said aperture, said outer frame and said inner frame each having a leg to protrude into the aperture in overlapping relationship, means for fastening said legs together to lock said frames to the said door, a sliding panel slidable on tracks on the inside of the door to close said aperture, and sealing means to seal the sliding panel to the inner frame when in the closed position.

2. A solid door as defined in claim 1, wherein said outer frame includes an outer peripheral channel to receive the security screen, and an adjacent channel to receive and lock therein the insect screen.

3. A solid door as defined in claim 1, wherein said tracks are attached to the horizontal upper and lower portions of the inside frame, each track including a web to engage a roller on said sliding panel, said inside frame including a sealing bead to seal on said sliding panel.

* * * * *